US005125225A

United States Patent [19]

Strobel

[11] Patent Number: 5,125,225

[45] Date of Patent: Jun. 30, 1992

[54] PROCESS FOR MAKING HOLLOW DIAMOND CUT ROPE CHAIN

[75] Inventor: Kalman Strobel, New York, N.Y.

[73] Assignee: A.K.S. Jewelry, Inc., New York, N.Y.

[21] Appl. No.: 792,002

[22] Filed: Nov. 14, 1991

[51] Int. Cl.[5] ..... B21L 17/00

[52] U.S. Cl. ..... 59/35.1; 59/30; 59/80

[58] Field of Search ..... 59/7, 16, 30, 34, 35.1, 59/78, 80

[56] References Cited

U.S. PATENT DOCUMENTS

| | | | |
|---|---|---|---|
| 848,299 | 3/1907 | Feid . | |
| 944,640 | 12/1909 | Ungerer et al. . | |
| 979,110 | 12/1910 | Ungerer et al. . | |
| 1,053,726 | 2/1913 | Hamm et al. . | |
| 1,886,784 | 11/1932 | Boppenhausen . | |
| 2,424,924 | 7/1947 | Chernow | 59/80 |
| 2,895,290 | 7/1959 | Devonshire | 59/90 |
| 3,083,002 | 3/1963 | Lacey | 269/7 |
| 3,410,085 | 11/1968 | Sheth | 59/84 |
| 3,711,069 | 6/1955 | Armbrust | 59/35 |
| 4,268,946 | 5/1981 | Eisenberg | 29/424 |
| 4,493,183 | 1/1985 | Bucefari | 59/16 |
| 4,503,664 | 3/1985 | Allazzetta | 59/16 |
| 4,651,517 | 3/1987 | Benhamou | 59/80 |
| 4,679,391 | 7/1987 | Tizzi | 59/20 |
| 4,681,664 | 7/1987 | Eberle | 204/9 |
| 4,682,467 | 7/1987 | Waltemyer | 59/30 |
| 4,716,750 | 1/1988 | Tizzi | 72/52 |
| 4,754,535 | 7/1988 | Valtiero | 29/33 |
| 4,996,835 | 3/1991 | Rozenwasser | 59/80 |

FOREIGN PATENT DOCUMENTS

| | | | |
|---|---|---|---|
| 2428647 | 1/1975 | Fed. Rep. of Germany | 269/7 |
| 0260644 | 10/1988 | Japan | 59/35.1 |

OTHER PUBLICATIONS

"Mr. Rope Chain", *ADFOR, Israel's Jewelry Magazine*, Summer, 1991, pp. 105-106, published by Mazal U'Bracha Publications, Ltd. c/o Israel Jewelry Manufacturer's Association, 7 Abba Hillel Silver Rd., Ramat-Gan, Herzlia, 46101, Israel.

*Primary Examiner*—David Jones
*Attorney, Agent, or Firm*—Kuhn & Muller

[57] ABSTRACT

By means of having taken advantage of certain physical properties of solids with a manufacturing process of incrementally deforming hollow links, there is produced new hollow diamond cut jewelry rope chain, which results in a product weighing up to 60% less than its solid counterpart, but which in its aesthetic looks is similar to solid diamond cut jewelry chains, and furthermore, with a hardness greater than the same hollow chain that has not gone through the process. This invention presents a new diamond cut chain, which costs a fraction of the price of a solid chain aesthetically similar.

12 Claims, 3 Drawing Sheets

PROCESS FOR MAKING HOLLOW DIAMOND CUT ROPE CHAIN

FIELD OF THE INVENTION

The present invention relates to the construction of a new original jewelry chain, heretofore known as a "hollow diamond cut rope chain", by making use of a novel process heretofore known as the "hollow diamond cutting process". The present invention is directed generally toward a concept of hollow annular link chain manufacture, including ornamentation of that chain. In particular, the present invention is directed toward forming flat impressions on the surface of the hollow annular chain links Because a hollow jewelry chain link is very thin, the thin walled tubing encompassing the hollow link cannot be sheared or cut, as is done with solid wire chain links to create a sparkled surface look from flat faceted impressions.

BACKGROUND OF THE INVENTION

Jewelry rope chains are necklace chains, or the like, made from a helicoid configuration of number of individual ring shaped annular links, which links are intertwined to form a double helix helicoid resembling a rope, and thus these chains are known as rope chains. The prior art includes a diamond cut solid annular rope chain, in which solid annular links are given a quality of sparkle by cutting and shearing away flat facets from the curved solid annual toroid links, leaving flat surfaces for light to reflect off of. Before discussing hollow, as opposed to solid, faceted chains, a review of jewelry chains in general is hereby noted.

In general, jewelry rope chains are made of precious or any other metals, and can be made of solid links, or of hollow links. The former are known as "solid rope chains" and the latter are known as "hollow rope chains".

As noted above, in order to add the sparkling quality to the solid rope chains, these solid rope chains are subject to a process known as "diamond cutting", which consists using sharp diamond cutting knives to cut off segments of the chain (usually known as "facetting"), in any given number of flat facets, and making use of various methods for cutting into the surface of the solid annular links so that these flat facets which will reflect light in various angles, making the particular diamond cut rope chain shinier than a non-diamond-cut chain. Therefore, these chains are known as "solid diamond cut rope chains".

However, the manufacture of solid diamond cut rope chains remains very expensive, because during the last two decades, the world of the jewelry business has suffered two economic misfortunes:

i. The world price for gold has increased about tenfold, from about US$35 a Troy Ounce, going to a peak of about US$850 a Troy ounce, through today's average price of about US$350 per Troy ounce; and, ii. The average consumer acquisitive capacity has suffered a decline. Even though world-wide this decline is hard to quantify because of the great fluctuations that most economies have suffered and continue to do so. However, such a decline can be felt by the average individual jewelry manufacturer in most developed countries.

These requirements have prompted the world's jewelry manufacturers in general, and the jewelry chain manufacturers in particular for a quest to create products that "look-alike" aesthetically to the heavier product of a solid gold chain, but are much lighter in weight. This look-alike simulated effect is achieved by using a lesser amount of precious material content in the jewelry objects being manufactured, without altering the appearance and "look" of such a heavier jewelry object, such as a solid gold chain.

Therefore, in the jewelry rope chain industry, many efforts have been made so that a hollow chain will exhibit the same aesthetic look of a solid rope chain, such that a reduction can be effected in the weight of the chain, thus reducing its cost. This has been achieved until now in various ways, such as for example, by manufacturing the annular links of a smaller diameter, by altering the size and thickness of annular links that conform a determined length of chain, and in trying to reduce the weight of a chain of the same length and similar appearance.

The largest breakthrough in the look-alike but costless quest was achieved when the rope chain industry created the aforementioned hollow rope chain, which in some cases reduce the original weight of a look-alike solid rope chain up to 50% and even 60%.

Such hollow rope chains are jewelry rope chains manufactured out of hollow annular links. A variety of weaving techniques may be used, with a variety of the number of links being intertwined. This is true whether the links be an odd or an even number of links. Moreover, the basic element of a hollow rope chain is an annular link that has a void in its inner side.

Hollow chains must meet certain qualitative manufacturing standards.

A well manufactured jewelry rope chain is one whose links are scratch-less, uniform in size and tightly woven. This is achieved in the solid rope chain by using clean, precise methods of link manufacturing, a very tight weaving process, which in the case of a handmade rope chain, demands an extra process called "tightening", entailing bunching the woven links as many as possible in a given length without bending the links out of its circular form. Care is taken also, in the soldering process, so as to "straighten" any misplaced links before applying the solder.

Because of the fact that hollow rope chains are in fact made from hollow links, hollow jewelry chains are more delicate than their look-alike solid links. As a result, the hollow links, and the hollow chain that is derived from such links is liable to be bent, bunched, warped or otherwise deformed before, during and/or after the manufacturing process.

In addition, because of the fact that a hollow link is manufactured from a very thin plate, the plate itself has to be perfectly made in respect to its thickness and width in order that a strong link be made out of it. The largest problem encountered in the manufacturing of a hollow rope chain is the fact that it can hardly be "tightened" because of its delicate structure. This gives place to a certain "looseness" in the finished hollow rope chain, which will not be encountered in a well made solid rope chain.

Before discussing the imprinting of flattened facets upon hollow rope chain links, it is necessary to describe the manufacture of linked rope chains in general.

Specifically, solid and hollow jewelry rope chains are made by machines and by hand. When a plurality of links are intertwined to form a double helix helicoid chain the rope chain is produced. Each link in the rope chain is generally curved, annular and, curved again in a C-shape. The links are referred to as "annular" since the these ring shaped links wrap around each other. The jewelry industry uses two types of annular links in the art of rope chain manufacturing:

1. With respect to closed links, this is where each individual annular link is soldered in the closing, thus not allowing the intertwined links to come apart. The closings of the annular links are oriented in the same direction.
2. where each annular link has an opening or gap slightly larger than the wire diameter from which the said annular links are made, this permits one of said annular links forming the rope chain to pass through the gap of another of the annular links forming the rope chain. The orientation of the gap of the links is alternating, so that when the gap of two angularly intertwined and laid adjacent links is thereto, said second annular link is oriented so that its said gap is 180 degrees removed from the orientation of the first link gap. Two adjacent links with gaps 180 degrees orientation are soldered together, intermittently at the external periphery.

Jewelry rope chain made of these closed links are generally referred to as "machine made rope chains", and the rope chain made of open links, whether they are made by machines or by hand are called "hand made rope chains".

Machine made rope chains can have any number of intertwined links odd or even number equal or greater than 2.

Hand made rope chains can have only odd number of intertwined links equal or greater then 3.

The size of the inner annular diameter of a typical annular, ring shaped link for the hand made rope chain in the prior art of the rope chain has been a slightly over 3:1 ratio (e.g. 3.2–3.7:1) to the wire diameter of the wire from which the solid annular links are made of.

Having discussed the formation of rope chains in general, it is necessary to discuss the relevance of the annular links to hollow chains in general.

As noted before, the increasing gold price of the last two decades promoted a competition between the chain manufacturers and chain machine manufacturers to create more lighter and lighter chains having the same aesthetic appearance as a heavier chain but less gold content.

To achieve the above, the following constraints are noted.

With the higher the number of annular links being intertwined, whether the rope chain is a machine made rope or a hand made rope chain, the thinner must be the wire diameter from which the annular links are made. Furthermore, the thinner the wire diameter from which the annular links are made for the same outside diameter of chain and the same unit length of chain, will result in a lighter chain.

Also the basic element of the hollow rope chain, namely the hollow link, while it is being formed, the tubular link requires (due to the very thin wall) the introduction of a supporting wire introduced during fabrication to allow the forming of the link. In the absence of the introduced core, the thin wall would fracture.

With respect to the introduction of a supporting core, it must be noted that there are two types of hollow tubes, each requiring a separate type of inner support during formation. One type is known as a "seamless" tubular link, which is a basically toroid donut shaped link with an uninterrupted, continuous surface. After finishing assembling the chain made of the "seamless" precious metal tubing, with a non-precious metal core, the nonprecious metal core has to be removed by dissolving it in concentrated acid. Such an operation is very slow, due to limited surface contact between the acid and the metal core. With this technology there are a very limited quantity of chains made.

The second type of tubular link is a "seamed" tubular link, also generally toroid donut shaped in configuration, but which presents an circumferential gap or "seam" on the inner circumferential surface, similar in shape to an automobile tire with a gapped seam on its inner circumference.

A more simple, less complicated, more efficient way is being widely used in the art of chain manufacturing with the aforementioned "seamed" tubular link, which has the inner circumferential gap as in an automobile tire configuration. The seamed tubular links are formed when a sheet metal plate of 0.002–0.004" together with a solid non precious metal core is drawn through a round die so that the sheet metal of precious metal forms an open tube with a non precious metal core. The precious sheet metal is wrapped around the non precious metal wire allowing an opening of 15%–20% of the median circle of the circular cross-sectional ring formed.

The opening along the formed link allows the access of the acid to the non precious metal core on the entire length of the link thus accelerating the dissolving of the non precious metal core. However, the thus formed hollow links are very thin, and subject to fracture. Therefore they cannot be sheared and cut, to create flat, sparkling facets, as is done with solid link rope chains.

In contrast, as noted before, diamond cutting of solid link chains is a well known finishing step in the manufacturing of jewelry chains. By shearing or cutting, and removing a very thin layer of metal (0.002–0.004") by special diamond cutting tool, a very highly reflective surface is created, with a shine which surpasses other shines made by any other method.

Diamond cutting of solid links of solid rope chains is accomplished with a deep cut being used, so that from the round rope chain a four or six faceted square or hexagon shaped in cross-section results. This way the diamond cut flat surface created in the solid chain gives an enhanced sparkling look to the chain.

Until now, due to the very thin wall of the hollow chains and especially hollow rope chains, diamond cutting as aforesaid was impossible to envision.

For example, to achieve a square or hexagon in cross-section like chain, the depth of the cut would have to be greater than the wall thickness of the annular tube the hollow rope chain is made of.

In view of the aforesaid complexities of jewelry rope chain manufacture, various methods have been patented to improve the rope chain manufacturing technology.

U.S. Pat. No. 4,716,750 of Tizzi discloses rotary swaging and annealing, repeated in sequence, to produce hollow articles with various tubular cross-sections. U.S. Pat. No. 4,754,535 of Valtiero discloses the use of ice as a packing material support for surface alteration of thin continuous stock. U.S. Pat. No. 2,424,924 of Chernow and U.S. Pat. No. 2,711,069 of Ambrust describe methods of producing ornamental facets on solid wire chain links through grinding operations. U.S. Pat. No. 3,083,002 of Lacey and U.S. Pat. No. 4,268,946 of Eisenberg disclose the use of a solidifying material, such as ice, as a chuck to hold jewelry workpieces in place. Both of these patents are directed towards cutting of thin metal workpieces, the Eisenberg '946 patent particularly directed toward cutting tubular members.

U.S. Pat. No. 2,895,290 of Devonshire, U.S. Pat. No. 3,410,085 of Sheth, U.S. Pat. No. 4,679,391 of Tizzi and U.S. Pat. No. 4,682,467 of Waltmeyer disclose stamping impressions into solid chain links. The '391 patent is directed particularly toward jewelry.

U.S. Pat. No. 4,681,664 of Eberle discloses the altering or reinforcing of hollow thin walled jewelry articles by electroforming at stress points (such as at joints to increase their strength). U.S. Pat. No. 4,996,835 of Rozenwasser discloses the use of both solid or hollow links in jewelry rope chains, and German Patent No. 2428647 appears to disclose the use of a solidifying agent as a chuck to hold workpieces.

The aforementioned patents do not describe a hollow rope chain bearing generally flat, reflective facet surfaces to increase visual sparkling effect while maintaining the structural integrity of the annular links of the hollow rope chain.

The aforementioned patents either disclose making hollow tubings, such as disclosed in the Tizzi '750 patent, or the surface alteration of solid links, such as disclosed in Chernow '924, Ambrust '069 and Tizzi '750 patents.

The Eberle '664 patent concerns the altering of hollow jewelry articles by electro forming the hollow articles at stress points but does not describe a method of incrementally deforming curved hollow links to produce a flattened facet surface.

The Valtiero '535 patent discloses altering flat, thin metal strips by applying a supporting base, such as ice, and then impressing the strip with pre-coined impressions.

However, the Eberle '664 and Valtiero '535 do not describe the surface deformation of the curved surface of an annular ring shaped jewelry link by the application of incremental pressure upon the curved wall surface, thereby deforming the curved outer wall inward until a flattened surface appears.

OBJECTS OF THE INVENTION

The primary object of the invention is to substantially reduce the cost of a rope chain, namely the "solid diamond cut rope chain", by enabling the manufacture of a "faceted hollow rope chain" out of a "hollow rope chain," thus being able to reduce its weight in up to 60%, and thus creating a "hollow diamond cut rope chain", by having made use of a special technique which is referred to as the "hollow diamond cutting process".

A secondary object of the invention is to solve the ever existing problem of the "frailty" inherent in the hollow rope chain jewelry. This "frailty" problem is greatly alleviated by the "hollow diamond cutting process" which, by incrementally altering the structural configuration of the individual hollow links, allows for a hollow rope chain to be strengthened by incremental deformation. As a result, the chain is more resistant to wear and tear deformations due to the chain wearer's use.

Accordingly, it is a further object of the present invention to provide a hollow rope chain jewelry with a diamond cut surface appearance, which avoids the disadvantages of the prior art.

More particularly, it is an object of the present invention to provide a hollow diamond cut rope chain of the above-mentioned type, in which portions of its hollow annular link pieces can be flattened, thus simultaneously providing a simulated "sheared and cut" faceted look on the surfaces of the annular links, and which is snag-resistant while at the same time is inexpensive to manufacture, and simple to install and to remove.

SUMMARY OF THE INVENTION

In keeping with these objects and with others which will become apparent hereinafter, one feature of the present invention is directed to a hollow rope chain made of a very thin wall, such as 0.002–0.008", wherein there is a plastic deformation of the hollow rope chain links and the resultant simulation of diamond cut facets of the hollow rope chain.

Each hollow link, whether "seamless" or "seamed" with a gap as aforesaid, is conventionally formed into an annular toroid shape. In the "seamed" version, there is presented an inner circumferential surface of the link which bears a gap, similar in shape as that packaged in a common automobile tire, with the exception that a second gap is created to leave a space to insert each end of each link within each other in a helicoid manner. Furthermore, in a "seamless" link, there is only one gap, similar to the second gap of the "seamed" link.

After the "seamed" or "seamless" links are woven into a helicoid chain, the hollow rope chain is tightly wound on a hollow drum, such as a 24–30 inch diameter drum held between the centers of a universal lathe. The ends of the hollow rope chain are secured to a fastener on each end of a hollow drum, with a copper wire connected to the hollow chain. The drum is rotated slowly while through a rotating coupling union on one end of the drum, a freezing medium, such as glycol at about 10 degrees Celsius, is being circulated from a refrigerating unit to the drum. While the temperature of the drum with the hollow chain tightly wound on it is dropping, cold water is sprayed on the drum, from a hand held shower source. Almost instantaneous, the water touching the drum freezes and layers of ice will enclose the outer surface of the links of the hollow rope chain, covering the whole drum. Due to capillary forces in the small tubing of the hollow annular links, very little of the sprayed water will reach the inside of the tubing. Thus it will result in a perfect ice mold around the outside shape of each constituent link of the hollow rope chain. This description is similar to the prior art preparation of any solid chain to be diamond cut on a so-called ice lathe according to the prior art of diamond cutting on an ice lathe.

At this point, the present invention departs from the prior art by utilizing the ice mold in which the hollow rope chain is embedded as a holding means for an incremental plastic deformation of the hollow rope chain links, instead of just a holding instrument for diamond cutting.

In accordance with an advantageous feature of the present invention, there is incrementally applied a blunt force to the links, which blunt force is applied by a burnishing tool gradually advancing forward toward the rear of the links with increments of 0.002–0.003 inches in distance, for each passage of the tool along the lathe, while the lathe is rotating at 200–300 RPM. Therefore the walls of the hollow rope chain link are subjected to a plastic deformation in the area of the contact of the burnishing tool. Additionally, the combination of the longitudinal and forward advancing of the burnishing tool is done until a flattened surface is created. With each passage of the burnishing of the tool, a small portion of the curved surface is pushed inward. In addition, because the burnishing is done while the tool is advancing longitudinally as well as forwardly toward the surface of the link, the surface of each link is deformed slightly in both an inward and longitudinal direction. By also moving the burnishing tool longitudinally with each passage, there is avoided the tendency of the curved surface to deform in a concave manner, as opposed to the desired, flattened manner.

The resulted flattened surface has a high reflectivity and the sparkling shines of a solid link rope chain equal in appearance to the conventional solid diamond cut rope chain jewelry.

The ice is removed with hot water and the process is repeated four times until the formerly round link has a flattened faceted surface in the area where the blunt force is applied.

The flat surface creates a reinforced resistance for tangential torsion forces applied on the chain, resulting in a stronger, more wear resistant, hollow rope chain than the hollow rope chain before being subjected to deformation.

When the device is designed in accordance with these features, it achieves the above specified objectives.

In accordance with an advantageous feature of the present invention, the surface part of each link is flattened, allowing it to simulate the sheared and cut faceted surfaces of solid links. The incremental blunt force burnishing allows the user to easily deform the walls of the hollow links. Additionally, each simulated facet is gently and continuously deformed in a series of incremental deformations, which finally terminate when the hollow surface is at or near the rear surface of the hollow link. The control of the incremental deformations of the flat surface appearance simulates a sheared, cut facet, after being deformed inward, with an increased resistance to fracture of thin hollow link walls.

The novel features of the present invention ar set forth in particular in the appended claims. The invention itself, however, both as to its construction and its manner of operation, will be best understood from the following description of preferred embodiments, which is accompanied by the following drawings.

DESCRIPTION OF THE PREFERRED EMBODIMENT

Figure 1:
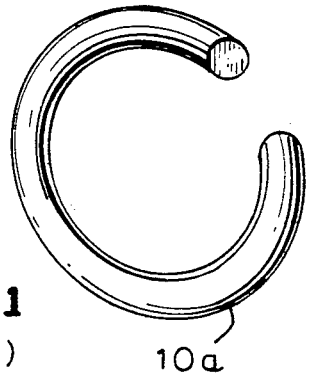
Fig. 1 (PRIOR ART)
FIG. 1 shows the existing solid link of a rope chain.
Figure 2:
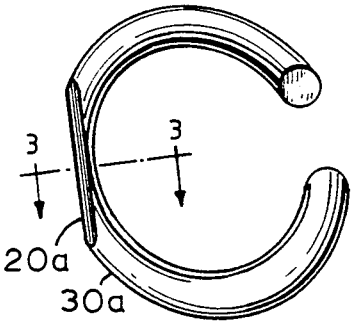
Fig. 2 (PRIOR ART)
FIG. 2 shows the existing solid link with a portion sheared and cut away leaving a flat surface.
Figure 3:
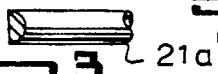
Fig. 3 (PRIOR ART)
FIG. 3 is a close up view of part of the solid link when viewed against line 3—3 of FIG. 2.

According to the prior art, as shown in FIG. 1, a solid annular chain link 10*a* is sheared as shown in FIG. 2, resulting in a flat, faceted surface 20*a*. FIG. 3 depicts a section 21*a* of the prior art link 20*a*, when viewed along line 3—3 of FIG. 2.

Figure 4:
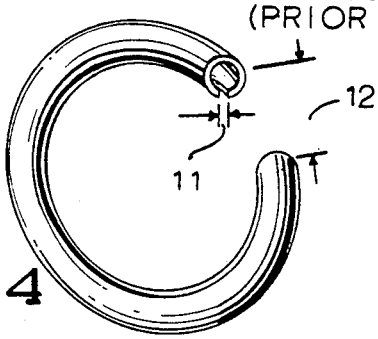
FIG. 4 is the proposed hollow link.
Figure 5:
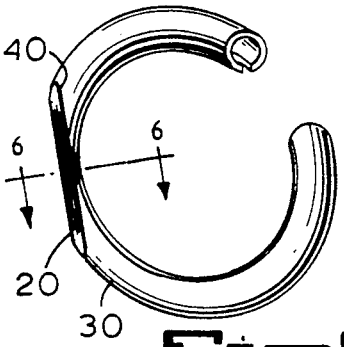
FIG. 5 is the proposed hollow link with a portion deformed inward leaving a generally flat surface.
Figure 6:
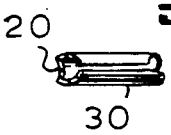
FIG. 6 is a close up view of part of the hollow link when viewed against line 6—6 of FIG. 5.

As shown in FIGS. 4, 5 and 6, a hollow link 10 is shown of an annular shape. More specifically, its toroid shape more closely resembles an automobile tire, with an inner gap 11 presenting on the inside surface of the round annular link 10. A further gap 12 is provided by removing a section of the annular link 10, to permit the intertwining of a plurality of hollow links 10, 10', 10, etc. within each other, as shown in the rope configuration helicoid of FIG. 7.

Although FIGS. 4, 5 and 6 depict a "seamed" hollow link 10 with the aforementioned inner gap 11, it is noted that the present invention also applies to a "seamless" hollow link with a continuous surface without an inner circumferential gap.

Each seamed link 10 has a curved circumference in cross-section which is interrupted by a first gap 11 extending from a first boundary part 14 of the circumference in cross-section of link 10, to a second boundary part 15 of the circumference in cross-section of link 10.

Each link 10, whether it is "seamed" or "seamless", is curved about its longitudinal axis, such that one end of the link 10 extends around a curve towards the second end of the link, such that the link forms a C-shaped member, with the ends spaced apart from each other by a second gap 12 intersecting the circumference of link 10, which results in link 10 assuming a C-shaped configuration.

Each link 10 has an outer surface wall in the shape of a toroid (three-dimensional donut shape). The outer surface wall of each link 10 has an outer surface wall portion 30 which extends bilaterally outward along the outer surface of link 10 from a first outermost circumference of the outer surface of link 10 to a second circumference of the outer surface of link 10. The second circumference is a median midpoint between the first outermost circumference of the outer surface of link 10 and a third innermost circumference of each link 10. A rear surface wall portion (opposite the outer surface wall portion 30) is defined by that portion of the outer surface of link 10 extending from the aforesaid second median midpoint circumference to the aforesaid third innermost circumference. In the "seamed" link, the rear surface wall is divided into upper rear surface wall portion 31 and lower rear surface wall portion 32, which wall portions 31 and 32 are separated by first gap 11 as noted hereinabove. Seamless links do not have such first gap 10 at their inner circumference.

As noted in FIG. 5, flat facets 20 are impressed against the rounded outer surface 30 of hollow link 10 by the incremental deformation of rounded outer surface 30 of hollow link 10. This incremental deformation causes a structural change on surface 30 of link 10, without altering its topological properties. This structural change which gives hardness and resistance against deformation to any annular shaped object, such as hollow link 10, is caused by the deformation of one or more rounded segments 30 of link 10 into one more flattened surfaces 20. Any of these flat surfaces 20 by definition has to have a delimitation that separates it from the surrounding round surface 30, thus creating an irregular boundary line 40 where the flat surface 20 meets rounded surface 30. The boundary line 40 thus created imparts the simulated edges of a distinct flat diamond cut 20*a* upon prior art solid link 10*a*, so even though the deformed surface 20 is not quite flat, its deformation is made at such an incremental rate that the tendency of curved wall 30 to deform into a concave surface is minimized by the gradual incremental deformations of curved surface 30 with applications of blunt force.

Furthermore, the simulated faceting of a conglomerate of hollow links 10, 10',10", etc. that comprise together a "hollow diamond cut rope chain", gives each link 10,10',10", etc. a much greater resistance and structural hardness than an undeformed conglomerate of perfectly round hollow rings making up a hollow rope chain.

Figure 7:
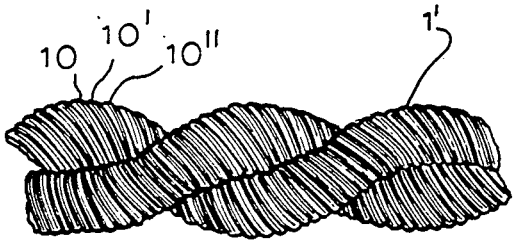
FIG. 7 is a perspective view of an assembled portion of the hollow chain without the simulated "diamond cut" impression.
Figure 8:
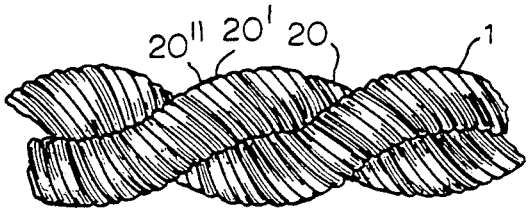
FIG. 8 shows a perspective view of an assembled portion of the hollow chain showing in white the simulated sparkling "diamond cut" impressions.

As shown in FIG. 7 there is depicted a typical hollow rope chain 1' without any flat facets. However, as shown in FIG. 8, there is illustrated a typical hollow diamond cut rope chain 1 with flat facets 20, 20', 20", etc. upon links 10, 10', 10", etc.

Figure 10A:
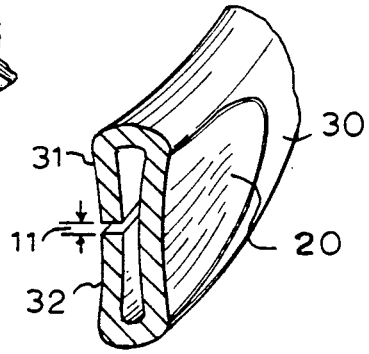
FIG. 10*a* is a further close-up partial sectional perspective view of one of the hollow links with a completed "diamond cut" impression.
Figure 9:
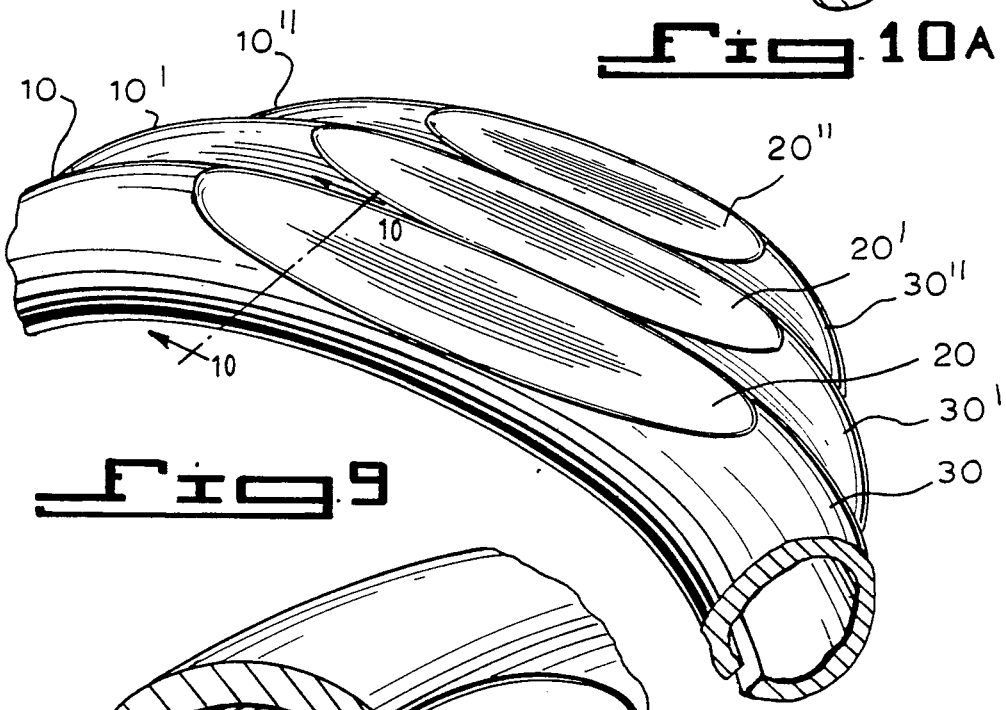
FIG. 9 is a close-up partial sectional perspective view of several of the links as shown in FIG. 8.
Figure 10:
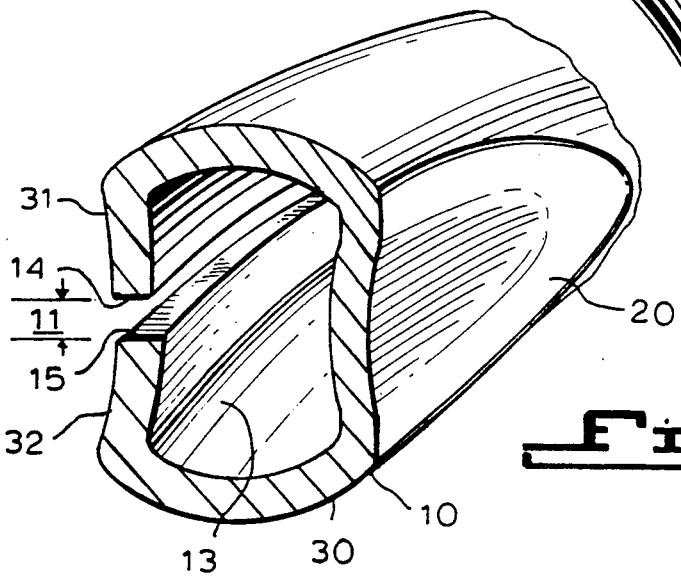
FIG. 10 is a further close-up partial sectional perspective view of one of the hollow links with a partially complete simulated sparkling "diamond cut" impression, as viewed along lined 10—10 of FIG. 9.

As shown in FIGS. 9 and 10, the solid seamed links 10, 10', 10" are deformed with flattened surfaces 20, 20', 20", etc. on a portion of curved surfaces 30, 30', 30" etc. of hollow links 10, 10', 10", etc. away from inner gaps 11, 11' (not shown) and 11" (not shown) of annular hollow links 10, 10', 10", etc. With respect to "seamless" links, the seamless links are deformed with similar flattened facet surfaces on a portion of the outer curved surfaces away from its inner curved surfaces, which inner curved surfaces do not present a gap, such as first gap 11.

FIG. 10 illustrates a typical hollow seamed annular link being deformed by facet section 20 within boundary line 40 of curved outer wall 30. During the deformation process, rear upper wall portion 31 and rear lower portion 32, separated by gap 11, are likewise deformed inward toward outer wall portion 30 being deformed reciprocably inward by the incremental application of blunt force upon outer curved wall portion 30 in the region of facet 20.

As a result, there is depicted in FIG. 10A a completely flattened faceted surface 20 of outer surface wall 30 of hollow link 10, which link 10 also presents flattened rear upper wall portion 31 and rear lower wall portion 32.

Because the application of blunt force is done incrementally, while the links 10, 10', 10" are frozen, the tendency of faceted surface 20 to form a concave impression is minimized, and the risk of shredding or tearing of the hollow links 10, 10', 10" etc. is also minimized.

Figures 11, 12:
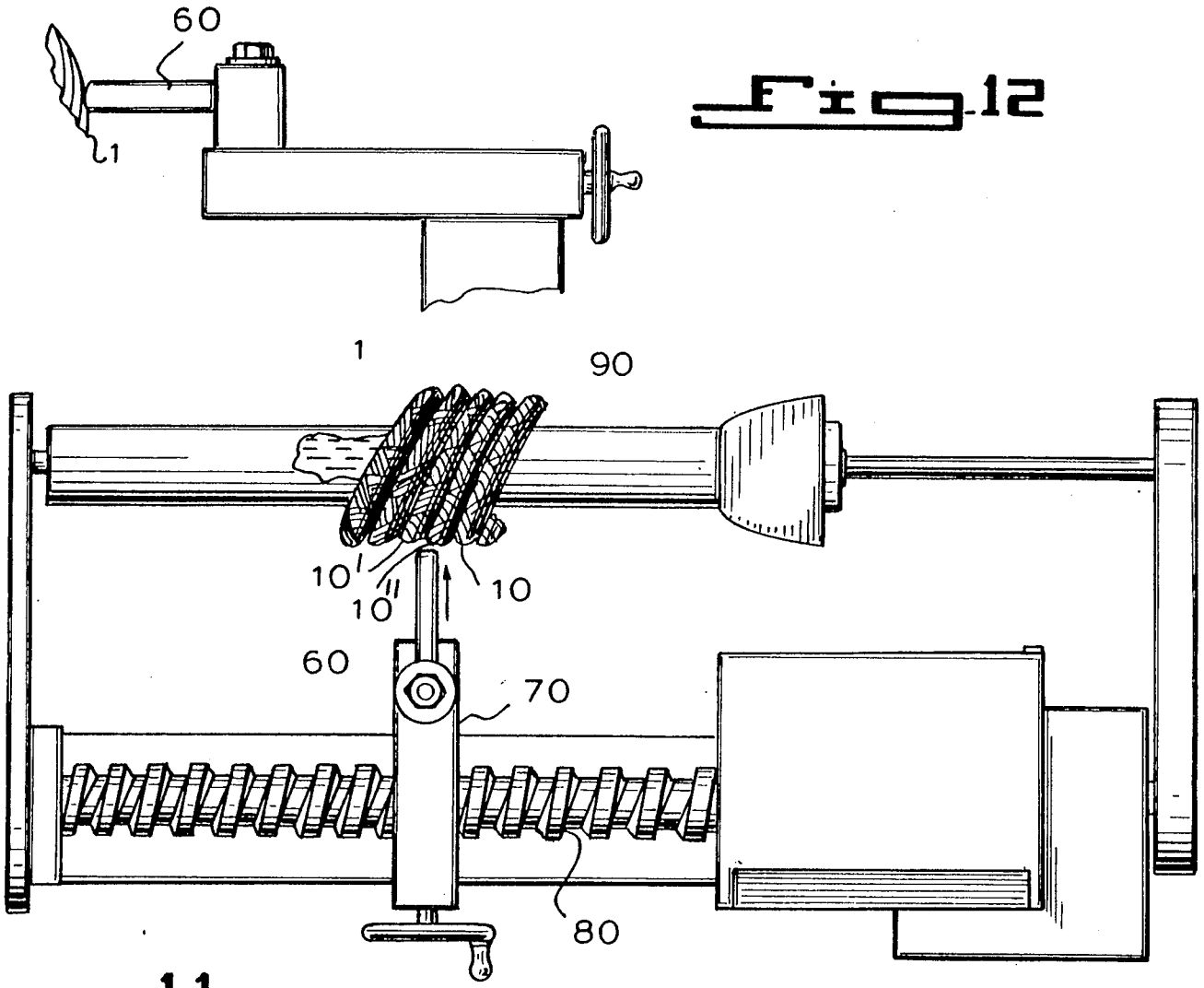
FIG. 11 is a top plan schematic view of a typical machine for making the product, with a portion of the chain shown in dotted lines, around the rotating drum.
FIG. 12 is a close up view of the burnishing portion of the machine as shown in FIG. 11, with the burnishing head pressing against a link.

FIGS. 11 and 12 show the diamond cut hollow rope chain 1 with links 10, 10', 10", etc. being deformed by blunt, burnishing tool 60, which is incrementally advanced longitudinally and forwardly toward hollow rope chain 1 against links 10, 10', 10", etc. below in the region of facets 20, 20', 20", etc. Burning tool 60 has support member 70, which advances along conventional movement mechanism 80, while chain 1 is held in place as aforesaid by being frozen upon lathe drum 90.

An example of the process of making the hollow diamond cut rope chain is as follows:

First chain 1 is wrapped around drum 90, while drum 90 is filled with freezing medium, such as glycol. Water is then sprayed onto the outer surfaces of chain links 10, 10', 10" etc. Little or no water will traverse into gaps 50 of a typical link 10, so ice would not form therein. This results in a hollow spatial gap 13 within which a portion of curved wall 30 is deformed while transforming from an arc shaped segment into flattened facet 20. The incremental pushing and deforming of the curved walls 30 of link 10 is accomplished when the outside of wall 30 is deformed toward the inside wall portions 31 and 32 of link 10, until facet portion 20 is almost adjacent to inner wall portions 31 and 32, as shown in FIG. 10*a*.

A typical example of the mathematical distances which wall 30 moves is as follows:

The hollow link 10, manufactured of approximately 0.0025 of an inch plate of a precious metal, such as gold, is wrapped around a less precious metal such as copper, which is later removed with acid. (Aluminum may be used and removed with caustic soda). The tube thus formed is sliced into hollow segmented links 10, 10', 10", etc. When the links are woven into a helicoid chain in a double helix pattern, they are held in place by steel wire. The wires are put within the hollow links 10, 10', 10", etc., which links 10, 10', 10", etc. are weaved into a hollow rope chain 1. The links 10, 10', 10", etc. are held in place by the steel wire until soldering of the links is complete and the steel wire is mechanically removed. Then the supporting aluminum or copper is removed from inside the links to obtain completely hollow links 10, 10', 10", etc.

Then the hollow chain 1 with links 10, 10', 10", etc. is wound around the frozen drum 90, and the chain 1 is showered with water to imbed the exterior of hollow chain 1 with ice. Dull, incremental pressure is applied off center to the surfaces of the links 10, 10', 10" etc., whose surfaces 30, 30', 30" etc., are gradually pushed in at a rate of 0.002" per passage of the burnishing tool, which starts deforming the links at one end of the chain and goes progressively to the links at the other end.

As shown in FIGS. 10 and 10A, the curved hollow outer wall portion 30, which includes faceted region 20, and rear wall portions 31 and 32, are incrementally pushed toward each other until the back outer wall portions 32 and 32 meet inner surface of front wall portion 30 containing faceted portion 20.

After approximately 8 passages of the blunt force upon the outer wall 30 (the cross sectional thickness of each wall being approximately 0.0025 inch in thickness and the passages deforming wall 30 inward a distance of 0.002 inches for each application of blunt force) the outer wall 30 is moved approximately 0.016 inches inward. As a result, the original hollow link, having an original outer diameter of 0.025 inches, including the 0.0025 inch thicknesses of each front and rear wall portion, is deformed a total of 0.016 inches, so that the now deformed link has a thickness of 0.009 inches, which includes the total wall thicknesses of 0.005 inches (each wall having been 0.0025 in thickness.)

The resultant links 10,10',10'', etc. have a cross sectional profile as depicted in FIG. 10A, in which the forward wall portion 30 bears flattened faceted portion 20, and the forward wall portion 30 is almost adjacent to rear wall portions 31 and 32, also almost flattened by the indirect effects of the application of blunt force upon wall portion 20.

When the deforming is complete, small irregular surface portions can be sheared of to further simulate the flat faceted look of each link.

It is noted that because the blunt force is applied in small increments to move the wall 30 inward in increments of only 0.002 inches per passage of blunt force, the remaining portions of the links 10,10'10'', which are located outside of the boundary line 40 encompassing faceted portion 20, remain curved, thereby simulating the curved portions of solid links, in solid chains, which are not subject to the prior art application of shearing from sharp diamond cutting tools. With each passage of the burnishing of the tool 60, a small portion of the curved surface 30 of link 10 is pushed inward. In addition, because the burnishing is done while the tool 60 is advancing longitudinally as well as forwardly toward the surface of the link 10, the surface of each link is deformed slightly in both an inward and longitudinal direction. By also moving the burnishing tool 60 longitudinally with each passage, there is avoided the tendency of the curved surface 30 to deform in a concave manner, as opposed to the desired, flattened manner.

It is to be noted that other modifications made be made to the construction of the present invention, without departing from the spirit and scope of the appended claims.

I claim:

1. The process of manufacturing a hollow diamond cut rope chain comprising the steps of:

preparing a plurality of hollow segmented links, said links having a toroid, annular configuration interrupted by an inner gap along an inner circumference of said annular links, said links having a curved outer wall portion spaced apart from said inner circumferential gap, said outer wall portion having a center opposite said inner gap, and said links having opposite said curved outer wall portion two inner wall portions separated from each other by said inner gap along said inner circumference of said annular links, applying said links in a rope chain configuration;

wrapping said links about a lathe drum;

freezing said drum;

applying water to said chain upon said frozen drum until said water, and said outer and said inner wall portions are frozen;

advancing a blunt burnishing tool against said links to apply a plurality of incremental deformative thrusts of blunt force against said curved outer wall portions of said hollow links until said wall against which said deformative force is being applied is pushed back toward said opposite inner wall portions of said hollow link, said outer wall portions being flattened by said application of said incremental blunt force.

2. The process as in claim 1, wherein said advancing of said blunt burnishing tool against said curved outer wall portions of said hollow links is selectively administered, such that portions of said outer wall portions are flattened during said selective administration of said advancing blunt burnishing tool against said curved outer wall portions of said hollow links.

3. The process as in claim 1, wherein said blunt force is applied against said frozen outer wall portions of said links, against a void within said links until a portion of said outer wall is depressed inward and adjacent to said opposite inner wall portions of said links.

4. The process as in claim 1, wherein the force is applied obliquely off center against said links, off of the center of said curved outer wall portion of said links.

5. The process as in claim 1, further comprising imparting one or more flat reflective surface facets upon said outer wall portions of said links, including the steps of applying in multiple successive passages incremental blunt force in both inward and longitudinal directions with respect to said hollow links against selected portions of said outer wall portions of said links, deforming said outer wall portions inward until said outer wall portions are adjacent to said inner wall portions, and reciprocably flattening said inner wall portions inward toward said outer wall portions.

6. The process as in claim 1, wherein said tool is advanced longitudinally and inwardly, with respect to said lathe drum, against said curved outer surface of said links.

7. The process of manufacturing a hollow diamond cut rope chain, comprising the steps of:

preparing a plurality of hollow segmented seamless links, said links having a toroid, annular configuration;

applying said seamless segmented links in a rope chain configuration;

wrapping said links about a lathe drum;

freezing said drum;

applying water to said chain upon said frozen drum until said water is frozen;

applying a blunt burnishing tool against said links to apply a one or more incremental deformative thrusts of blunt force against an outer wall portion of said seamless links until said outer wall portion against which said blunt force is applied is pushed back toward an opposite inner wall portion of said seamless links, said outer wall portion being flattened by said application of blunt incremental force.

8. The process as in claim 7, wherein said blunt force is applied obliquely off center against said seamless links, off a center of said curved outer wall portion of said links.

9. The process as in claim 7, wherein said tool is advanced longitudinally and inwardly, with respect to said lathe drum, against said curved outer surface of said links.

10. The process as in claim 7, wherein said advancing of said blunt burnishing tool against said curved outer wall portions of said hollow links is selectively administered, such that portions of said outer wall portions are flattened during said selective administration of said advancing blunt burnishing tool against said curved outer wall portions of said hollow links.

11. The process as in claim 7, wherein said blunt force is applied against said frozen outer wall portions of said links, against a void within said links until a portion of said outer wall is depressed inward and adjacent to said opposite inner wall portions of said links.

12. The process as in claim 7, further comprising imparting one or more flat reflective surface facets upon said outer wall portions of said links, including the steps of applying in multiple successive passages incremental blunt force, in both inward and longitudinal directions with respect to said hollow links, against selected portions of said outer wall portions of said links, deforming said outer wall portions inward until said outer wall portions are adjacent to said inner wall portions, and reciprocably flattening said inner wall portion inward toward said outer wall portions.

* * * * *